United States Patent [19]

Sander

[11] Patent Number: 4,568,001

[45] Date of Patent: Feb. 4, 1986

[54] PACKAGING TUBE

[75] Inventor: Engelbert Sander, Vouvry, Switzerland

[73] Assignee: Automation Industrielle SA, Vouvry, Switzerland

[21] Appl. No.: 550,487

[22] Filed: Nov. 9, 1983

[30] Foreign Application Priority Data

Nov. 12, 1982 [DE] Fed. Rep. of Germany ..... 3241977

[51] Int. Cl.[4] ..... B65D 35/08

[52] U.S. Cl. ..... 222/107; 222/541; 156/69; 156/294

[58] Field of Search ..... 222/92, 107, 81, 94, 222/541; 428/35; 156/69, 294, 203, 218; 215/10, 31

[56] References Cited

U.S. PATENT DOCUMENTS

| | | | |
|---|---|---|---|
| 2,671,577 | 3/1954 | Remington et al. | 222/81 X |
| 3,144,964 | 8/1964 | Goff et al. | 222/107 X |
| 3,179,313 | 4/1965 | Malglaive | 222/81 X |
| 3,231,156 | 1/1966 | Schultz | 222/92 |
| 3,260,411 | 7/1966 | Dobson | 222/107 |
| 3,565,293 | 2/1971 | Schultz | 222/107 |
| 4,060,179 | 11/1977 | McGhie | 222/92 |
| 4,132,331 | 1/1979 | Magerle | 222/107 |
| 4,185,757 | 1/1980 | Schultz | 222/107 |
| 4,526,297 | 7/1985 | Grimsley | 222/107 |

FOREIGN PATENT DOCUMENTS

| | | | |
|---|---|---|---|
| 720700 | 11/1965 | Canada | 222/92 |

*Primary Examiner*—Joseph J. Rolla
*Assistant Examiner*—Kevin P. Shaver
*Attorney, Agent, or Firm*—Collard, Roe & Galgano

[57] ABSTRACT

A packaging tube is provided which is substantially gas-tight and has low absorptivity, consisting of a tube of multilayer composite foil with a metallic barrier layer, a prefabricated plastic head piece having a discharge opening and an external thread, and a connecting body which consists of a composite foil containing a metal layer and at least one thermoplastic material layer. The head piece is placed on the connecting body and is welded thereto by means of the plastic layer. The circumferential rim of the tube overlaps the outer rim of the connecting body extending over or under the same, and its plastic layers are softened by the inductive generation of heat in the metal of the composite foil and are welded together while pressure is applied. The head piece has the shape of a cylinder or a truncated cone and is joined at its base area completely to the connecting body. At its lower end, the discharge opening has an enlargement in which at least one annular depression is made, into which plastic material of the connecting body is introduced during softening. The connecting body has a neck which corresponds to the shape of the enlargement and consists of an annular profiled washer or a profiled lid having an integral diaphragm.

10 Claims, 4 Drawing Figures

Fig. 1
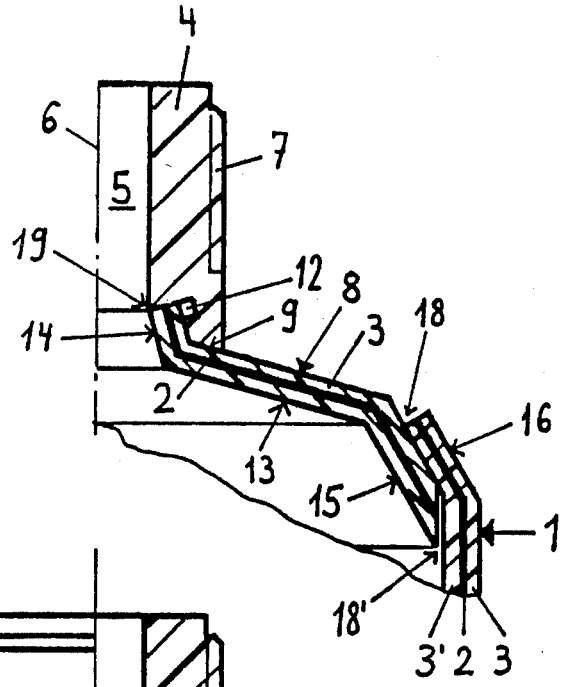
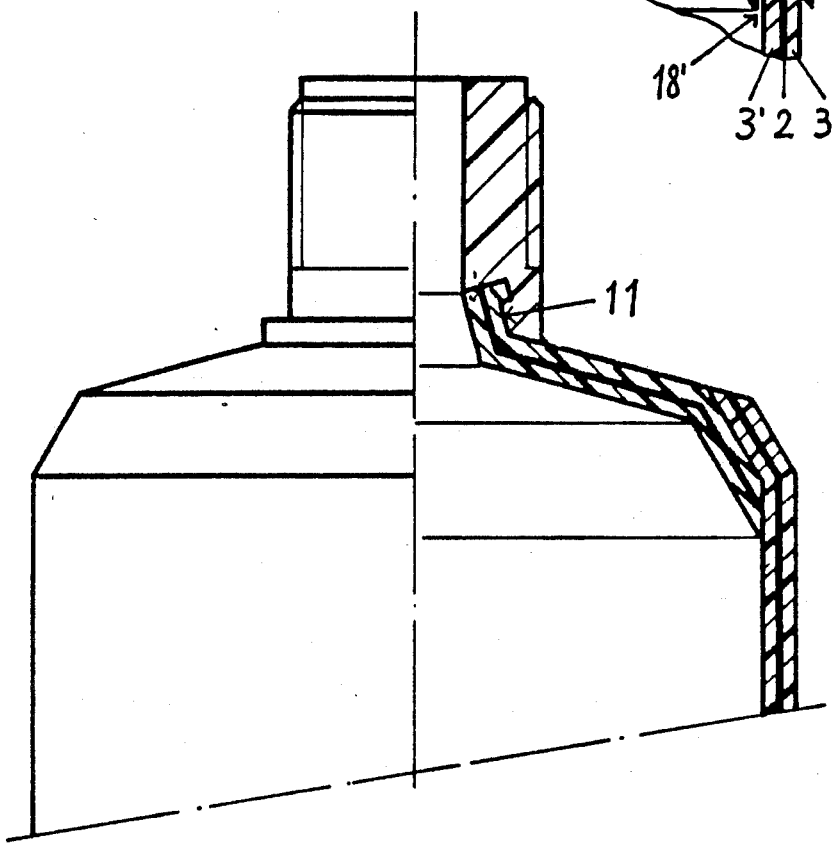
Fig. 2

Fig. 3
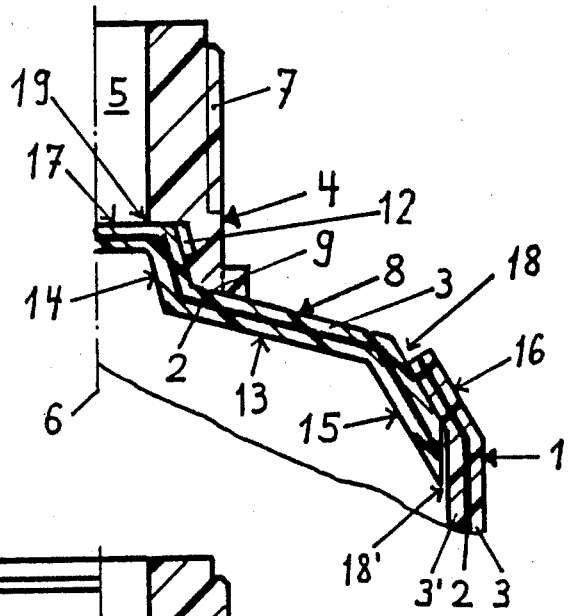
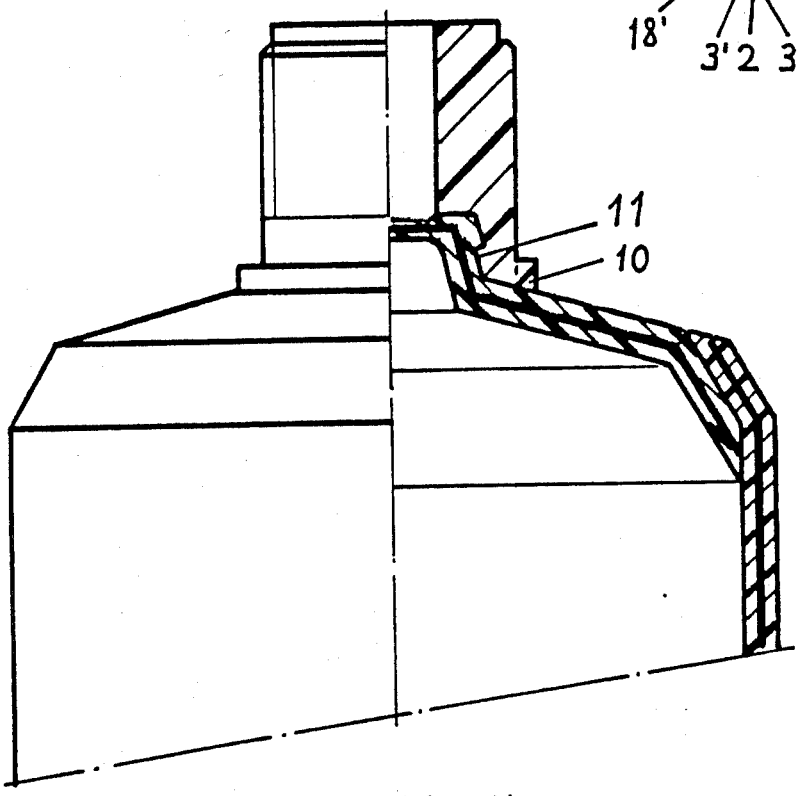
Fig. 4

PACKAGING TUBE

The present invention relates to a packaging tube consisting of a tube of composite multilayer foil with a metallic barrier layer, a prefabricated head piece which consists of plastic and has a discharge opening and an external thread, and a connecting body which consists of a composite foil containing a metal layer and at least one thermoplastic material layer on which the head piece is placed and is welded thereto by means of the plastic layer. The circumferential rim of the tube overlaps the outer rim of the connecting body, extending under or over it, and their overlapping plastic layers are softened by the inductive generation of heat in the metal of the composite foil and are welded together while pressure is applied.

A tube of this type is known from FIG. 3 and the corresponding description of DE-OS No. 26 28 014. In the tube of this patent document, the circumferential rim of the tubular body consisting of a laminate having a metallic barrier layer extends over the outer rim of a connecting body having a metallic barrier layer. The connecting body has a relatively large cylindrical neck portion on which a tube head consisting of polyethylene is arranged. The neck portion of the connecting body engages a circular groove in the tube head, whereby the tube head is divided inward into a sleeve and outward into a collar. Because of the relatively great length of the neck portion of the connecting body, the latter is produced by a winding process, where the development is stamped out of a laminated sheet and thereafter the edges are joined to form a ring having an overlap seam. The connecting body made in this manner is then joined to the head by friction heat before connection to the tube is made.

Such a tube can meet quite well the requirement with respect to diffusion resistance which is demanded of modern tubes, since the metal barrier layer of the connecting body extends under the metal barrier layer of the tube and extends far into the neck of the head piece to the vicinity of the discharge opening of the tube. Also, the plastic-layer areas which come into contact with the contents of the tube are relatively small, so that absorption behavior of the tube is satisfactory. However, as explained above, the manufacturing technology for this tube is complicated and the parts are joined together in several successive steps. By the winding of the connecting body, overlap seams are produced which, on the one hand detract from the aesthetic appearance of the tube and, on the other hand, make the insertion into the annular groove of the head piece more complicated because of the greater thickness as compared to single-layer material. Also, such a construction creates problems in friction welding the parts together. Also, with such a tube it is not possible to provide a diaphragm in the discharge opening without incurring added costs.

It is, therefore, an object of the present invention to improve a tube of the type described above in such a way that, with approximately equal or better sealing and absorption properties, the individual parts are easier to produce and can be firmly joined together to form the finished tube in a single operation. At the same time, it is also possible to provide the tube with a diaphragm in the discharge opening.

The above object is achieved according to the present invention by providing a head piece made in the form of a cylinder or a truncated cone, which can be produced simply and requires little plastic material, resulting in a lighter and less expensive head piece. Due to the fact that the entire base area is connected to the connecting body, a connection of the two parts exists which occupies a relatively large area and is therefore durable and strong. This connection is further improved by introducing the connecting body into an enlargement of the discharge opening, at the base of the head piece, at an angle and connecting this part firmly to the wall of the enlarged discharge opening. In addition, the plastic material of the connecting body at this connection is introduced into a depression in the enlarged part of the discharge opening, so that a clamp-like engagement is produced, and optionally, a pin connection which can withstand the heaviest loads. This enlargement of the discharge opening ensures a smooth transition between the neck of the connecting body and the wall of the discharge opening.

If a tube without a diaphragm in the discharge opening is required, it is advantageous to form the connecting body as an annular profiled washer and, if a diaphragm is required, then as a profiled lid. Both are preferably produced by deep-drawing.

To ensure that the diaphragm can be pierced easily, its plastic layers may be thinned out during the tube forming process and the removed material fed to the depression in the head piece described above which is made larger for this purpose.

The conical enlargement of the discharge opening forms an insertion funnel therefor, which ensures good pressure distribution in the head area when the tube contents are squeezed out, since the parts welded to each other are pressed together.

The above described depression in the enlarged discharge opening of the head piece should preferably be made in the form of an annular groove which is easy to make and should preferably be made approximately perpendicularly to the longitudinal axis of the head in order to achieve a clamping effect.

If the tube has a very large diameter, it may be advantageous to enlarge the contact area of the head on the connecting body, which can be easily accomplished by means of an annular shoulder.

If the contents of the tube do not react with the metallic barrier layer (aluminum), the connecting body need be made with only two layers, which results in a savings of material.

If a three-layer connecting body is required, the second plastic layer may consist of a relatively permeable or a relatively impermeable material. In the latter case, the absorptivity in the head area can be lowered further.

It is advantageous to join all the parts of the tube firmly together in one operation. The present invention describes a tube which can be produced substantially more simply and cheaply than such a tube according to the state of the art. An inventive tube with a ring-shaped connecting body has about the same diffusion resistance as the known tube. A tube with a profiled lid, i.e., with a diaphragm, has greater diffusion resistance than the known tube since the discharge opening is covered by a metal layer. Due to the fact that the head piece, as well as the tube, can be joined together via the plastic layer on the connecting body, the layer of the connecting body facing the tube contents can be made of an impervious material (which is hard to fuse to other plastics) whereby the absorptivity in the shoulder region and in the tube head can be reduced if a ring-shaped profiled washer is used and, if a profiled lid is used, is precluded almost completely until the diaphragm is pierced, i.e. during the entire storage period.

The present invention will be described and understood more readily when considered together with the embodiments shown in the accompanying drawings, in which:

FIG. 1 is a cross sectional view of the head region of a packaging tube with a connecting body in the form of an annular profiled washer in the arrangement of the parts before they are joined together;

FIG. 2 is a cross sectional view (right half) of the cutout according to FIG. 1 after the individual parts are welded together, and an elevational view (left half);

FIG. 3 is a cross sectional view of the head region of a packaging tube with a connecting body designed as a profiled lid showing the parts before they are joined together; and FIG. 4 is a cross sectional view (right half) of the cutout according to FIG. 3 after the parts are welded together, and an elevational view (left half).

Now turning to the drawings, the packaging tube according to the present invention includes a tube 1 of a composite foil in the form of a laminated three-layer foil. A central aluminum layer 2 is joined on both sides to thermoplastic layers 3 and 3' as the outer layers which may consist of polyethylene or polypropylene, for instance. Both plastic layers 3 and 3' may be made of one material or of different materials and with different thicknesses, optionally also using intermediate layers, depending on the intended tube content, the tube size and other parameters.

The packaging tube of thermoplastic material (for instance, polyethylene) further includes a prefabricated head piece 4 having a central discharge opening 5. In the embodiment examples, the head piece 4 is shown as a cylinder. However, it is also possible to form the tube head 4 differently, namely, having the cross section of a trapezoid or a truncated pyramid, where only one side may be inclined to the longitudinal axis 6 of the head piece 4. The discharge opening 5 is shown as cylindrical, but it may also be tapered.

The head piece 4 has an external thread for screwing-on a cap (not shown). To increase the base area 9 of the head piece 4 which is in contact with a connecting body 8, an annular extension 10 may be provided at its lower end as clearly seen in FIGS. 3 and 4. Shoulder 10 may also be designed as a stop surface for the screw cap. At the lower end of head piece 4, discharge opening 5 is provided with a step-wise enlargement 11. The step may be inclined and undercut as in FIGS. 1 and 2, or straight as in FIGS. 3 and 4. After the step, the enlargement is continued downwardly cylindrically or tapered outwardly in a cone shape. In the cylindrical or conical part of the enlargement 11, a circular groove 12 is formed, which is preferably directly adjacent to the step. Groove 12 is preferably provided with at least one undercut edge. Also, several annular grooves or depressions of different shape such as crosses or blind holes, may be provided. These can also be formed in the base area 9 (all this is not shown).

Connecting body 8 according to the embodiment shown in FIGS. 1 and 2 is designed as an annular profiled washer. The conical main part 13 opens at its tapered end into a neck 14, angled upwardly, and at its enlarged end into an outer edge 15, angled downwardly. Neck 14 and the enlargement 11 of head piece 4 are designed, depending on each other, in such a manner that neck 14 enters or fits into enlargement 11 in such a way that after joining, a form-locking transition in discharge opening 5 between neck 14 and head piece 4 is ensured. The upper cut edge of neck 14 abuts against the undercut step. Outer rim 15 is angled so that an engagement under (as shown) or an overlap (not shown) with the inwardly-bent circumferential rim 16 of tube 1 is established.

Connecting body 8 according to the embodiment shown in FIGS. 3 and 4 is designed as a profiled lid. The profiled lid is designed and shaped similar to the annular profiled washer of FIGS. 1 and 2, except that the central opening of the washer, the diameter of which is equal or approximately equal to that of the discharge opening 5, is closed off. This part of the connecting body, which covers opening 5, serves as the diaphragm 17 which must first be pierced when the contents of the tube are to be emptied. For various tube contents, such as in the case of food, a diaphragm 17 is prescribed.

If a profiled lid is prescribed, the step of the enlargement can be made straight, i.e., perpendicular to the longitudinal axis of head piece 4, and/or groove 12 can be made larger.

Both forms of connecting bodies 8 are preferably made by deep-drawing as profiled lids; if they are used as profiled washers, diaphragm 17 is capped or punched out, which can be done without effort on the same machine.

Connecting body 8 can be designed with only two layers (not shown), an upper thermoplastic layer 3 laminated on aluminum layer 2, or with three layers, thermoplastic layers 3 and 3' each laminated over and under aluminum layer 2.

In the latter case, the lower plastic layer 3' may consist of a relatively impermeable material. This layer then does not have to be readily fusible with the plastic material of the tube head 4 and the tube 1 since both connections can be made with the upper, outer plastic layer 3. Plastic layer 3 which is arranged on aluminum layer 2 of connecting body 8 should be readily fusible to the material of tube head 4 and the material of the inner plastic layer 3' of tube 1. Since it is possible to make the connection by means of the upper plastic layer of the connecting body alone, the latter can be made, as indicated above, of only two layers. Specifically, if the intended tube content is not changed by direct contact with aluminum, then aluminum layer 2 may be exposed.

For manufacturing such a tube, head piece 4 is slipped with its enlarged part 11 onto the neck 14 of the connecting piece so far that the base area 9 of the head piece rests on the main part 13 of connecting body 8. Tube body 1 is then brought up with its circumferential rim 16 to the outer rim 15 of connecting body 8 extending under it, or with overlap. Thereupon, aluminum layer 2 in connecting body 8 and in the outer region of tube 1 is heated, for instance, by high-frequency induction, whereby the adjacent plastic layers 3 and 3' are softened and fused. By the simultaneous application of pressure, the firm connection of all tube parts to each other is ensured and the softened plastic is distributed so that groove 12 or other and wider depressions as well as the gaps 18 and 18' and a possible gap 19 in the vicinity of the joint between head piece 4 and neck 14 in discharge opening 5 are filled out (see FIGS. 2 and 4). By filling groove 12 and other possible depressions, a firm lock of connecting body 8 to head piece 4 is achieved which is in addition to the adhesive bond obtained by means of the softening of the plastic at the contact surfaces between head piece 4 and connecting body 8. By filling the gaps 18, 18' and 19 a uniform, aesthetic surface is obtained.

If a diaphragm 17 is provided, its softened plastic layers 3 and 3' are squeezed-out from the center to the edge into an enlarged groove 12, so that the plastic layers are substantially thinned out on or under metal layer 2 in the area of discharge opening 5. Thus, more material is available for the locking connection and, also, piercing of the diaphragm 17 is facilitated.

It is understood that the foregoing general and detailed descriptions are explanatory of the present invention and are not to be interpreted as restrictive of the scope of the following claims.

What is claimed is:

1. A packaging tube for material to be squeezed therefrom comprising:

(a) a tube portion of composite multi-layer material having a metallic barrier layer and including a circumferential rim;

(b) a prefabricated plastic head piece having an axial discharge opening therethrough, the lower end of said discharge opening having an annular undercut therein to define a skirt at the lower end of said head piece, said skirt including an annular, radially outwardly directed groove at about the juncture of said skirt with said head piece; and (c) a connecting body of composite multi layer material including a metal layer and at least one thermoplastic material layer interconnecting said tube portion and said head piece, said connecting body having a central neck which is short relative to said head piece and which is sized and shaped to correspond to the shape of the annular undercut in the discharge opening of said head piece, the neck of said connecting body having a central opening therein the upper end of which corresponds to the discharge opening of said head piece so that there is a smooth transition between said connecting body and said head piece, said connecting body having an outer rim which is overlapped by the circumferential rim of said tube portion and is welded thereto to form a continuous shape therebetween, the central neck of said connecting body being welded to said head piece at said annular undercut and the thermoplastic material of said connecting body being introduced into the radially, outwardly directed groove of said skirt to form a locking engagement therebetween which is enhanced by the pressure of the material squeezed from the tube.

2. The packaging tube as defined in claim 1, wherein the annular undercut of the discharge opening is of conical shape, expanding toward the tube.

3. The packaging tube as defined in claim 1, wherein the groove consists of at least one circular groove which extends approximately perpendicularly to the longitudinal axis of the head piece.

4. The packaging tube as defined in claim 1, wherein said head piece has at its lower end a ring-shaped extension extending outwardly therefrom.

5. The packaging tube as defined in claim 1, wherein said connecting body has additionally a lower plastic layer of a plastic material which is relatively impermeable.

6. The packaging tube as defined in claim 1, wherein said connecting body is a ring-shaped profiled disc.

7. The packaging tube as defined in claim 6, wherein said connecting body is produced by deep-drawing.

8. The packaging tube as defined in claim 1, wherein said connecting body is in the shape of a profiled lid including an integrated diaphragm.

9. The packaging tube as defined in claim 8, wherein said connecting body is produced by deep-drawing.

10. The packaging tube as defined in claim 8, wherein the plastic layer of the diaphragm of the profiled lid is thinned out to the remainder of the connecting body.

* * * * *